US007448400B2

(12) United States Patent
Jensen

(10) Patent No.: US 7,448,400 B2
(45) Date of Patent: Nov. 11, 2008

(54) MODULAR FRAME WITH PARABOLIC TOP

(76) Inventor: Norman L. Jensen, 1709 Hampshire Ct., San Dimas, CA (US) 91773

( * ) Notice: Subject to any disclaimer, the term of this patent is extended or adjusted under 35 U.S.C. 154(b) by 0 days.

(21) Appl. No.: 11/502,566

(22) Filed: Aug. 11, 2006

(65) Prior Publication Data

US 2008/0006316 A1 Jan. 10, 2008

Related U.S. Application Data

(60) Provisional application No. 60/819,011, filed on Jul. 7, 2006.

(51) Int. Cl.
*E04H 15/34* (2006.01)
*E04B 1/32* (2006.01)

(52) U.S. Cl. ..... 135/121; 135/97; 135/124; 135/144; 135/157; 52/80.2; 52/81.2; 52/82; 52/63

(58) Field of Classification Search ..... 135/95, 135/97, 121, 141, 156, 115, 905, 908, 147, 135/157–158, 120.4, 123–124, 144; 52/81.1–81.6, 52/63, 222, 80.1–80.2, 82–83
See application file for complete search history.

(56) References Cited

U.S. PATENT DOCUMENTS 2,719,384 A * 10/1955 Eames ..... 135/121
3,026,651 A * 3/1962 Richter ..... 52/81.4
3,533,202 A 10/1970 Gellert
3,660,952 A 5/1972 Wilson
3,773,061 A 11/1973 Berger
3,807,421 A * 4/1974 Geiger et al. ..... 52/63
3,874,396 A * 4/1975 Kirkham ..... 135/97
3,886,961 A 6/1975 Geiger et al.
3,925,940 A 12/1975 O'Connell et al.
4,008,730 A * 2/1977 Keklak et al. ..... 135/90
4,422,267 A 12/1983 Whitehouse
4,542,759 A * 9/1985 Kyner, Jr. ..... 135/122
4,555,878 A * 12/1985 Tringali ..... 52/81.1
4,882,884 A 11/1989 Browne
4,942,895 A * 7/1990 Lynch ..... 135/99
5,000,211 A 3/1991 Speare et al.
5,165,207 A * 11/1992 Oehlke ..... 52/81.3
5,230,196 A * 7/1993 Zeigler ..... 52/646
5,274,980 A 1/1994 Zeigler
5,411,047 A 5/1995 Reilly
5,581,960 A 12/1996 Lewis
5,598,668 A * 2/1997 Isom ..... 135/121
D382,348 S 8/1997 Dattner
5,673,720 A 10/1997 Cuthill
5,675,938 A * 10/1997 McLorg ..... 52/2.26
5,769,106 A 6/1998 Achuff (Continued)

FOREIGN PATENT DOCUMENTS

CH 673309 A5 * 2/1990

(Continued)

*Primary Examiner*—Winnie Yip

(57) ABSTRACT

In one embodiment, the disclosure relates to a free-standing structure which includes an eight-sided roof perimeter; at least four geodesic structures extending from four sides of the eight-sided roof perimeter and supporting the perimeter; and at least four legs, each leg structurally corresponding with one of the at least four geodesic structures for upholding the free-standing structure.

20 Claims, 15 Drawing Sheets

U.S. PATENT DOCUMENTS

| | | | | |
|---|---|---|---|---|
| D400,266 | S | 10/1998 | Dattner | |
| D408,085 | S | 4/1999 | Dattner | |
| 6,345,638 | B1 | 2/2002 | Warner | |
| 6,520,195 | B1 | 2/2003 | O'Neal et al. | |
| 6,578,593 | B2 * | 6/2003 | Leonarz | 135/20.1 |
| 6,708,455 | B1 * | 3/2004 | Niiduma | 52/81.2 |
| 6,766,623 | B1 | 7/2004 | Kalnay | |
| 6,832,455 | B1 * | 12/2004 | Tomlinson et al. | 52/259 |

FOREIGN PATENT DOCUMENTS

| | | | |
|---|---|---|---|
| DE | 3603354 | A1 * | 8/1987 |
| DE | 3701205 | A1 * | 7/1988 |
| WO | WO 9105124 | A1 * | 4/1991 |

* cited by examiner

MODULAR FRAME WITH PARABOLIC TOP

The instant disclosure claims the filing-date benefit of U.S. Provisional Application No. 60/819,011, filed Jul. 7, 2006, the specification of which is incorporated herein in its entirety.

The disclosure generally relates to a modular frame and a covering therefor. In an embodiment of the disclosure, the modular frame is a free-standing structure which can be positioned independently or it can be combined with other similar structures to provide a larger span of coverage.

BACKGROUND

Conventional frame tents, party tents, vestibule tents and common rental tents are readily assembled and disassembled frame structures which incorporate conventional slip fit elements for legs, perimeter and roof support pieces. Supporting legs of conventional tents are spaced at increments of 10 to 20 feet, around the perimeter, along with the related gable, hip or pyramid components needed to support the tent top. These multi-component assemblies provide the structural elements for supporting the fabric tops of these shelters.

Frame tents are normally restricted to an interior span of less than fifty feet wide due to structural requirements. This is because the large span roofs require additional support and cannot be free-standing. Accordingly, tents larger than 50 feet are classified as pole, bail ring tents, clear span beam or truss structures. Conventional large tents require either a center pole (for supporting the roof fabric), a special extrusion material (to be used as a clear-span beam supporting the roof fabric), or multiple structural pieces (for forming a clear-span truss supporting the roof fabric). The multiple structural pieces form the base for tensioning the fabric top between the structural elements.

Pole or bale ring tents require many perimeter support legs, commonly spaced between 5 feet to 15 feet for tensioning the top; while clear span beams or trusses units require multiple purlin spacers to maintain alignment and structural integrity of the support frame and commonly are spaced at varying distances up to 20 feet. The roofs of such tents normally extent above the perimeter frame a distance equal to 25 percent of the width of the tent for frame and pole tents, while structures may extend 25 percent, or more, of the width of the tent from the ground. A standard 20 foot by 20 foot frame tent may have as many as 59 structural elements plus the top; while the quantity of pieces required to setup larger tents increases in both quantity and length of pipes or extruded beams.

The conventional large tent structures also have a roof member which directly supports the center or a portion of the roof. The roof member has been an essential part of the conventional tent structures especially when the tent's size increases requiring larger roof-top material. The roof members are typically positioned inside the tent thereby interrupting the space under the roof of the tent.

The conventional large tents are also heavy, inefficient and costly to produce and maintain. Because of the many structural parts, they provide difficult and time-consuming assembly and disassembly. Moreover, the weight of the fabric-top limits the span of the tent. Accordingly, there is a need for a free-standing structural system that addresses these deficiencies.

SUMMARY OF THE DISCLOSURE

In one embodiment, the disclosure relates to a free-standing structure which includes an eight-sided roof perimeter; at least four geodesic structures extending from four sides of the eight-sided roof perimeter and supporting the perimeter; and at least four legs, each leg structurally corresponding with one of the at least four geodesic structures for upholding the free-standing structure.

In another embodiment, the disclosure relates to a modular free-standing structure comprising: a plurality of support members forming a roof support structure and defining a roof perimeter for the free-standing structure; a roof fabric covering the roof support structure; a plurality of load transfer structures upholding certain of the support members and transferring the weight of the roof support structure; a plurality of legs for receiving the weight of the roof support structure and upholding the free-standing structure, the plurality of legs defining a footprint perimeter for the free-standing structure; wherein the footprint perimeter is larger than the roof perimeter.

In still another embodiment, the disclosure relates to a free standing modular structure comprising a plurality of support members forming an eight-sided perimeter for receiving a roof cover; a plurality of geodesic structures, each geodesic structure sharing at least one support member with the eight-sided perimeter to define a geodesic area for receiving a geodesic cover; and a plurality of legs, each leg structurally corresponding with one of the plurality of geodesic structures, the plurality of legs defining a footprint area for the modular structure; wherein the footprint area is substantially equal to a sum of a roof cover area and the geodesic areas.

In still another embodiment, the disclosure relates to a method for providing a free-standing coverage for an obstruction-free area, the method comprising providing a support perimeter for receiving a roof cover; providing a plurality of geodesic corner structures to extend from the support perimeter and to receive a geodesic cover; and freestanding the roof cover by connecting each of the geodesic corner structures to a leg member.

BRIEF DESCRIPTION OF THE DRAWINGS

The embodiment of the disclosure will be discussed in referenced to the following non-limiting and exemplary drawings in which.

DETAILED DESCRIPTION

An embodiment of the disclosure relates to a wide-span modular free-standing structure. The modular structure combines the structural components of the fabric top with the structural elements of the support frame, eliminating the need for the additional roof-support bracing. While the top may have many geometric forms, in one embodiment the top is substantially octagonal. The octagonal top frame along with geodesic corners provides converge to the supporting legs with the built in parabolic shaped top. It also provides the necessary flowing curvature for water removal, while integrating structural tensioning of the top from the perimeter structural frame forms the base tent unit.

The octagonal perimeter frame of equal or unequal side dimensions provides support only at the four corners, thereby providing clear side openings, based upon the tent size, from 10 feet to 40 feet or larger. Due to structural requirements for snow or wind loadings, an interior wire cable system may be optionally added, along with a cable to fabric top tensioning rod to offset the loading needs. A tent according to one embodiment of the disclosure can incorporate conventional slip fit design elements for the octagonal perimeter frame, geodesic corners and the vertical legs.

The structural components (base plates, frame pipe fittings, pipes and modular assembly elements) can be constructed from any structural material products, including but not limited to steel, aluminums, plastics and composite products (i.e., carbon fiber) and alloys. The parabolic-shaped top can be constructed from any fabric which has structural supporting characteristics and can have either sewn or welded joints. Sidewalls or partition walls can be either attached to the fabric or side frame members and constructed from any fabric which has structural supporting characteristics and can have either sewn or welded joints. These walls can be attached with VELCRO® type connectors, zippers or webbing.

Figure 1:
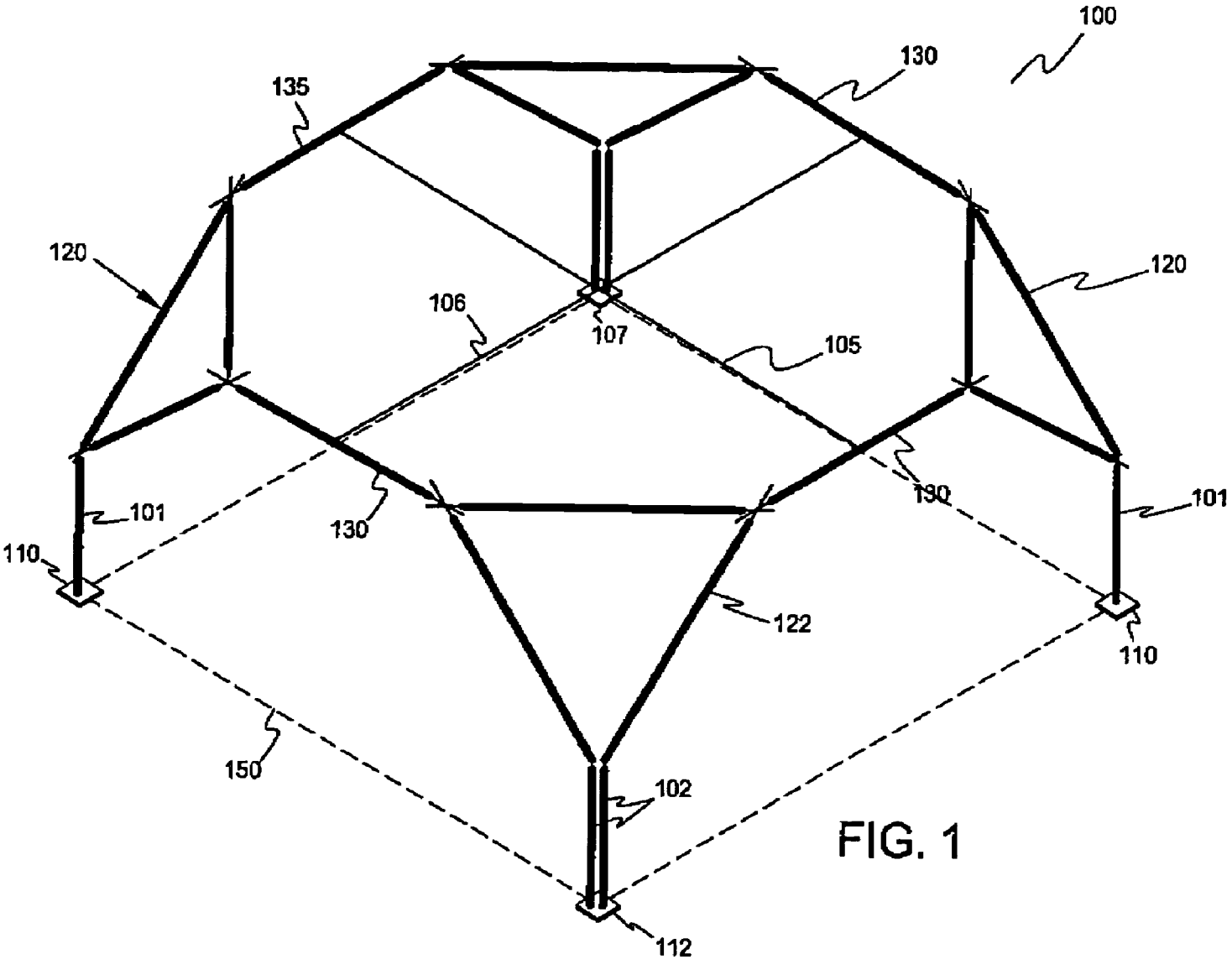
FIG. 1 is a plan view of a modular frame according to one embodiment of the disclosure.

FIG. 1 is a plan view of a modular frame according to one embodiment of the disclosure. To ease description, the structure of FIG. 1 is shown without a roof top. Referring to FIG. 1, the free-standing modular frame 100 includes base-plate. The base-plate defines a footprint which is the perimeter of the structure. That is, by drawing an imaginary line between the adjacent base-plates, a footprint for the structure can be determined. The base-palate 110 is shown to have several connections points for securing the structure to the ground. The connection points can be sized to receive an anchor or the like. Base plate 110 may have an integrated structure to receive one or more legs 101. For example, FIG. 1 also shows base plate 112 adapted to support two legs 102. Each leg couples (or connects) to a geodesic corner structure 120. The geodesic corner structure 120 comprises of at least three structural members coupled to each other to substantially form a triangle. The geodesic corner structure 120 may be adapted to receive more than one leg as shown in the geodesic structure 122. While the geodesic corner structure is shown as having three members forming a triangle, the principles disclosed herein are not limited thereto. Indeed, a corner structure not resembling the triangular shape shown in FIG. 1, for example a parabolic structure can be used without departing from the principles of the disclosure.

Figure 5:
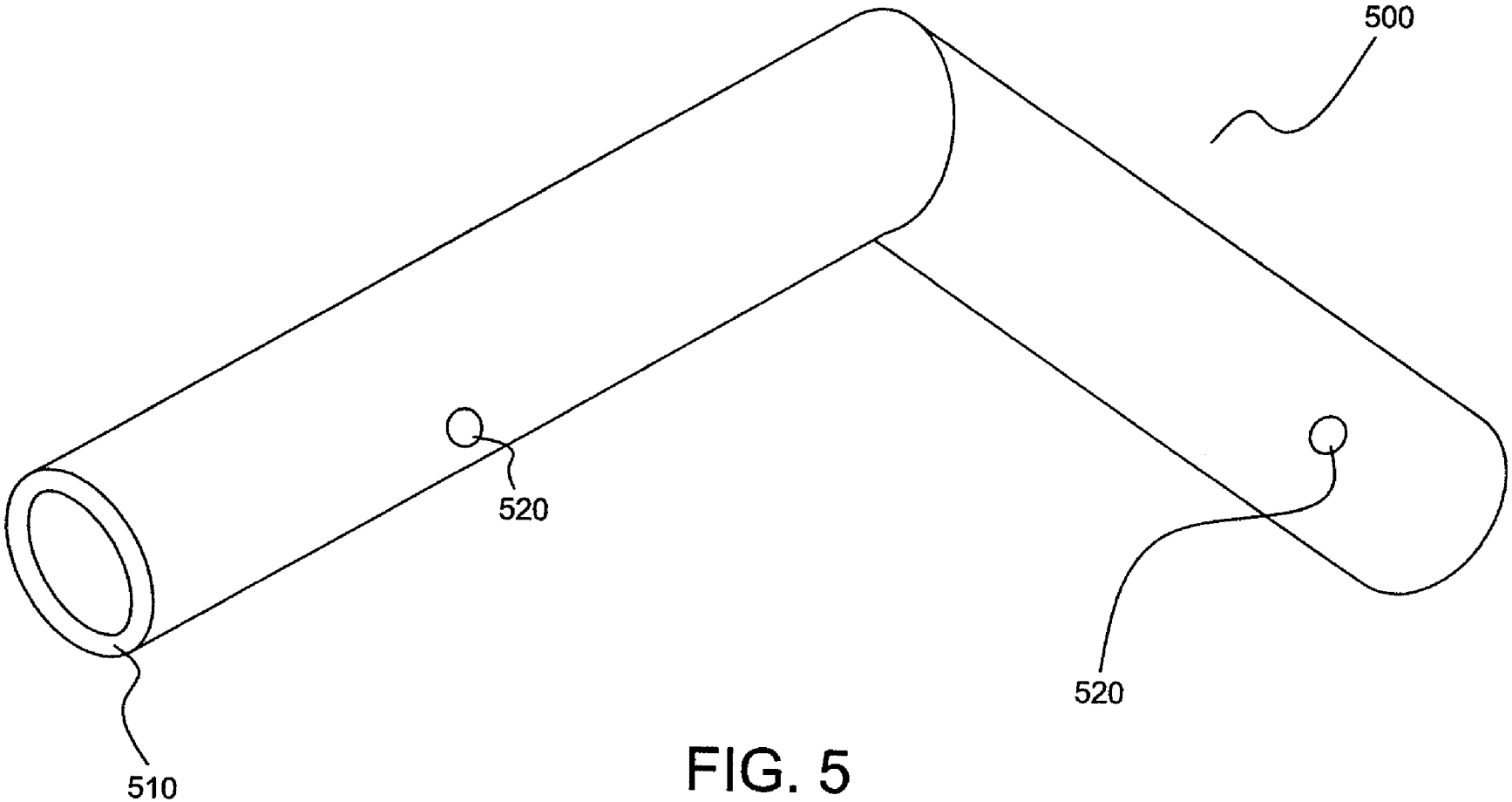
FIG. 5 shows a joint for connecting two members.

Structural support members 130 connect the geodesic structures to each other and can be seen as interposed between two adjacent geodesic structures. The connection of the support members and the geodesic structures forms perimeter 135, which in the non-limiting embodiment of FIG. 5, is octagonal. Parameter 135 provides a frame for receiving the roof-top material for the modular tent.

FIG. 1 also shows cross-members 105 connecting support members 130 to each other. Cross-members can be tension wires, bars, rods or any other conventional structural mean. As shown in FIG. 1 tension wires 105 and 106 meet at center point 107. While not shown in FIG. 1, a support bar can be placed at the center point 107 between the top tension wire 105 and the bottom tension wire 106 or above both wires (105 and 106) to the underside of the fabric top, to create a peak at the center of the modular structure 100. Once parameter 135 is covered by a roof-top material, the peak at center 107 will help repel water and debris. Thus, a peak is provided without the need to have a separate roof-support member that disrupts the space inside the structure. FIG. 1 also shows footprint 150 which is the surface area defined by foot-prints 110 (and 112).

While the exemplary embodiment of FIG. 1 shows cross members 105 and 106 connecting support members 130 which are opposite to each other, the principles disclosed herein are not limited thereto and can apply to cross-members which couple (or connect) adjacent support members.

It should be noted that because FIG. 1 is a plan view of a modular frame, the perimeter 135 may appear smaller than the foot-print of the modular frame. However, as will be demonstrated in side-view FIG. 3, such is not the case.

Figure 2:
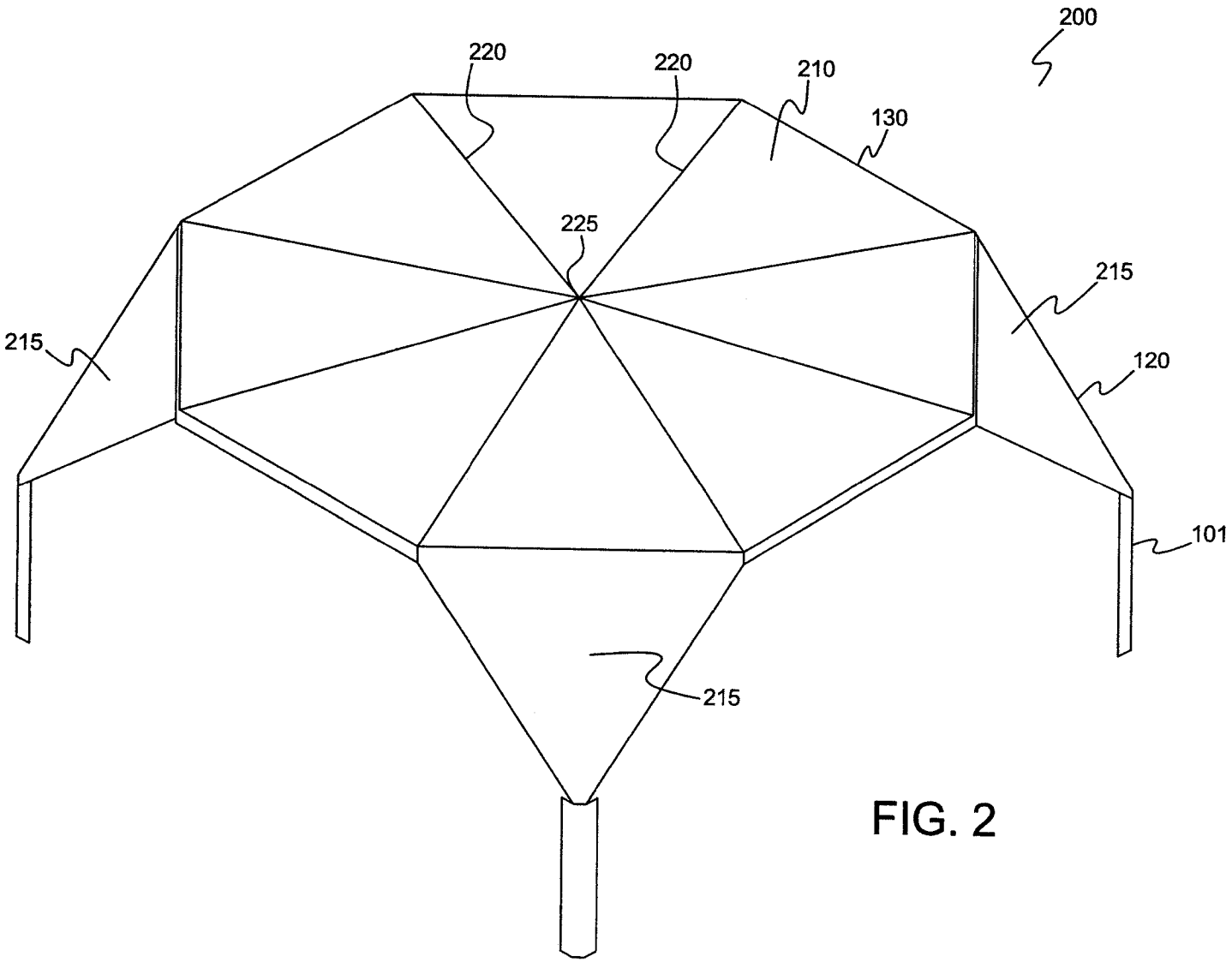
FIG. 2 is a schematic representation of an exemplary modular frame having the roof fabric assembled to the top of the frame pipe.

FIG. 2 is a schematic representation of an exemplary modular frame having the roof fabric assembled to the top of the modular frame pipe thereon. Referring to FIG. 2, modular frame 200 is shown with legs 101 supporting geodesic corner structure 120. A roof fabric 210 covers the top surface of the structure formed by the plurality of support members 130 and geodesic corner structures 120. The roof fabric can be extended to cover the space supported by each geodesic corner structure as is shown by regions 215. In the exemplary embodiment of FIG. 2, additional tension wires 220 adjoin opposite corners. The implementation of tension wires 220 is optional. In an alternative embodiment, the tension wires are support rods configured to provide a small slope or a slant by raising the center point 225 slightly above the support members 130. Such configuration enables the modular frame to shed water and debris. This top can be used to cover an individual wide span modular free standing structure or incorporated to cover the same frame, reconfigured to form a larger modular component interior clear span frame tent.

Figure 3:
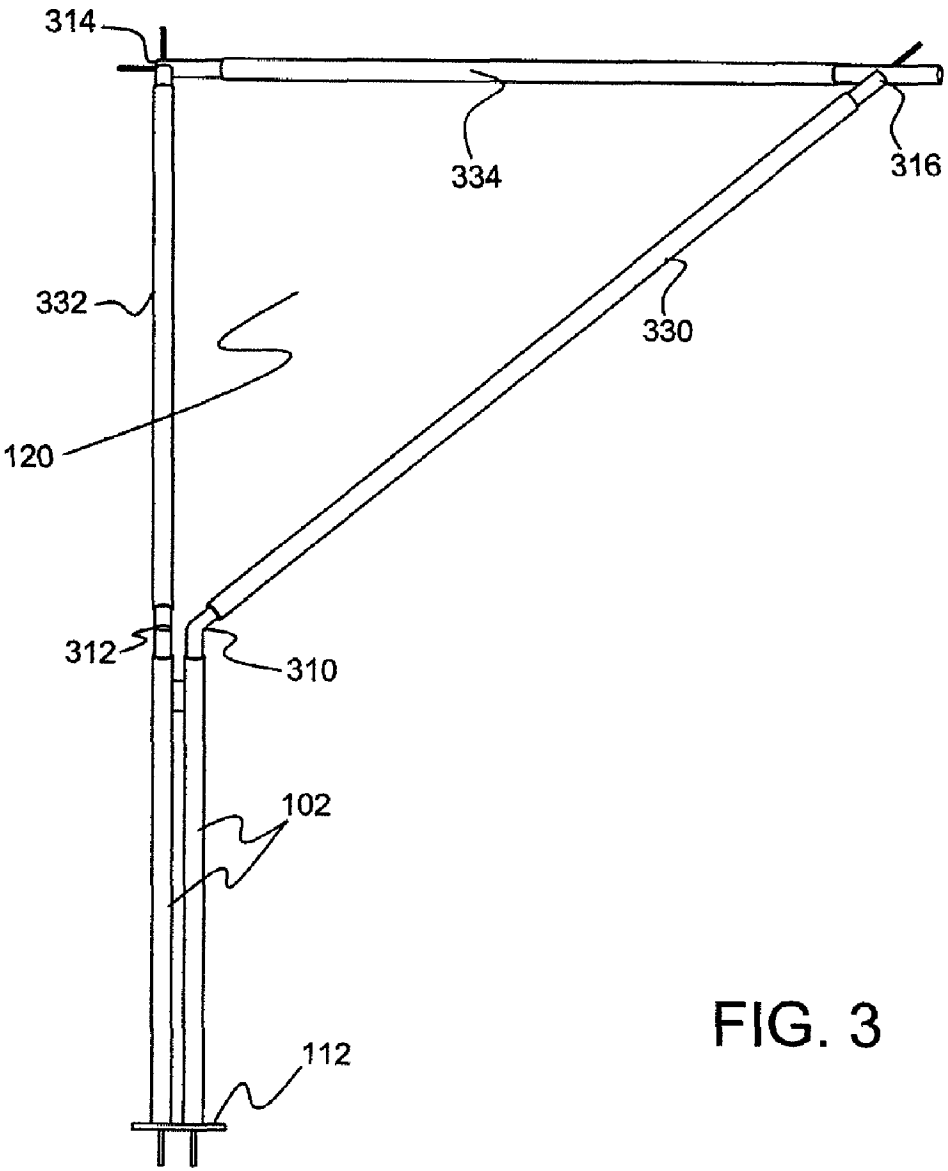
FIG. 3 is a side view of a portion of the modular structure shown in FIG. 1.

FIG. 3 is a side view of a portion of the modular structure shown in FIG. 1. In FIG. 3, base-plate 112 receives legs 102. Each leg 102 connects to geodesic corner structure 120 through a different joint 310, 312. Additional joints 314 and 316 define the geodesic corner structure 120. Bars 330, 332 and 334 can be fabricated from any conventional material including, aluminum, titanium, steel, carbon fiber, etc.

Because FIG. 3 is a side view, it can be readily seen that the coverage area of the roof top supported by roof parameter 135 is substantially similar to that the of the foot-print perimeter of the modular structure. In one embodiment, the size of the parameter 135 is substantially the same as the parameter defined by the base-plates 110. In another embodiment, the surface area of the foot-print is substantially equal to the surface area of the roof combined with the surface area of the geodesic portions.

Figure 4:
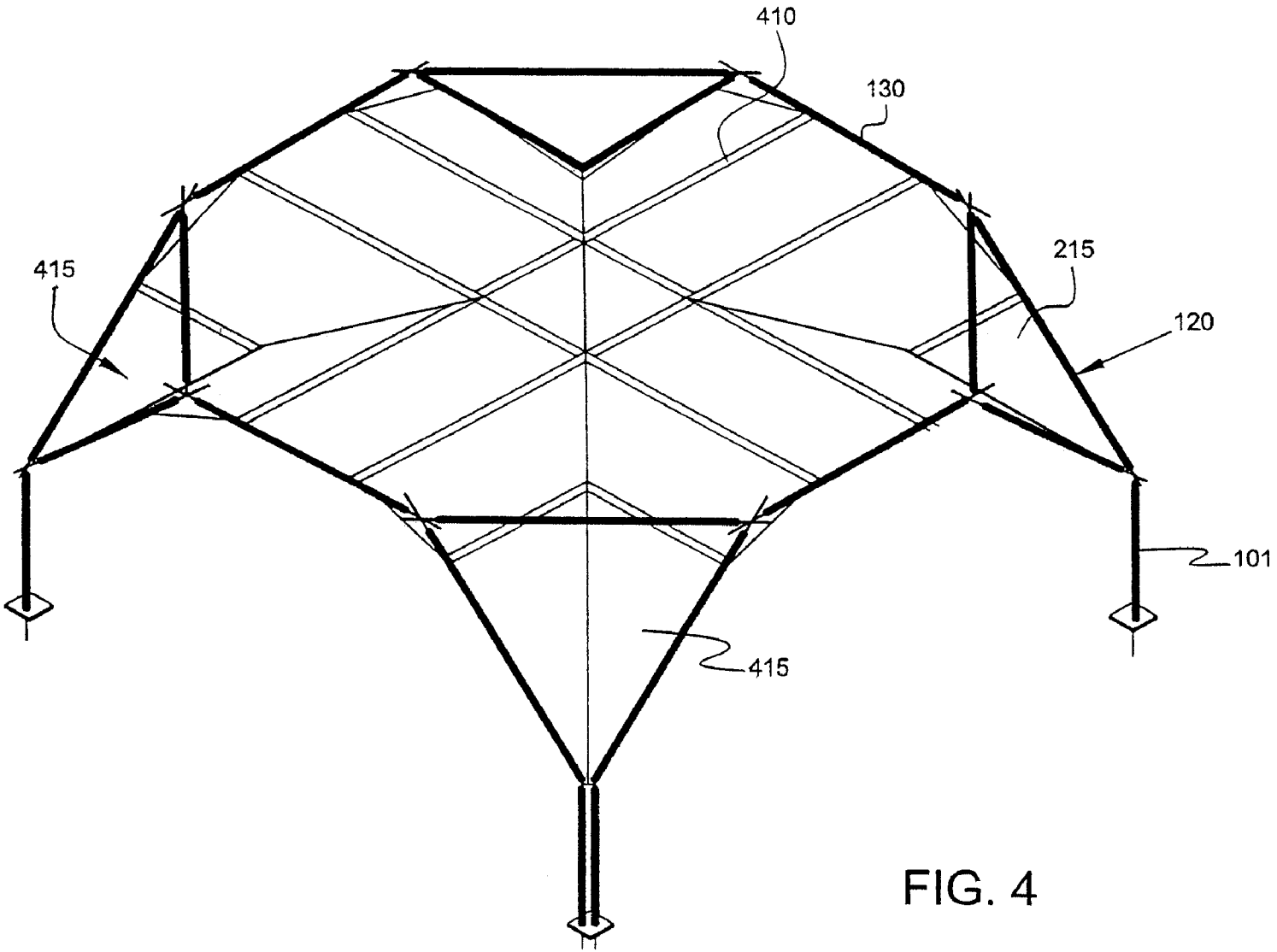
FIG. 4 is a plan view of an embodiment of the disclosure having parabolic shaped top where the fabric top is attached to the bottom of the frame pipe.

FIG. 4 is a plan view of an embodiment of the disclosure having parabolic top 410. Parabolic-shaped top 410 can be made of any conventional material having structural value including, for example, vinyl, PVC, canvas, etc. The parabolic-shaped top extends to cover the geodesic portions 415. The parabolic-shaped top can be attached to the bottom side of the modular frame and can have a parabolic shape which creates a curvature from the center of the top to the corners, providing for drainage and debris removal. This parabolic-shaped top also provides a structural bracing of the modular frame to reduce lateral movement from the wind.

FIG. 5 shows the exemplary joint 500 which can be use in connection with the principles disclosed herein. Joint 500 generally has an elbow shape and may form a right-angle. Opening 510 can be sized to receive a leg, a part of the geodesic structure or cross members. An optional notch 520 is formed on each side of the joint to receive a complementary ball or release mechanism. From the member which is received by the joint.

Figure 6:
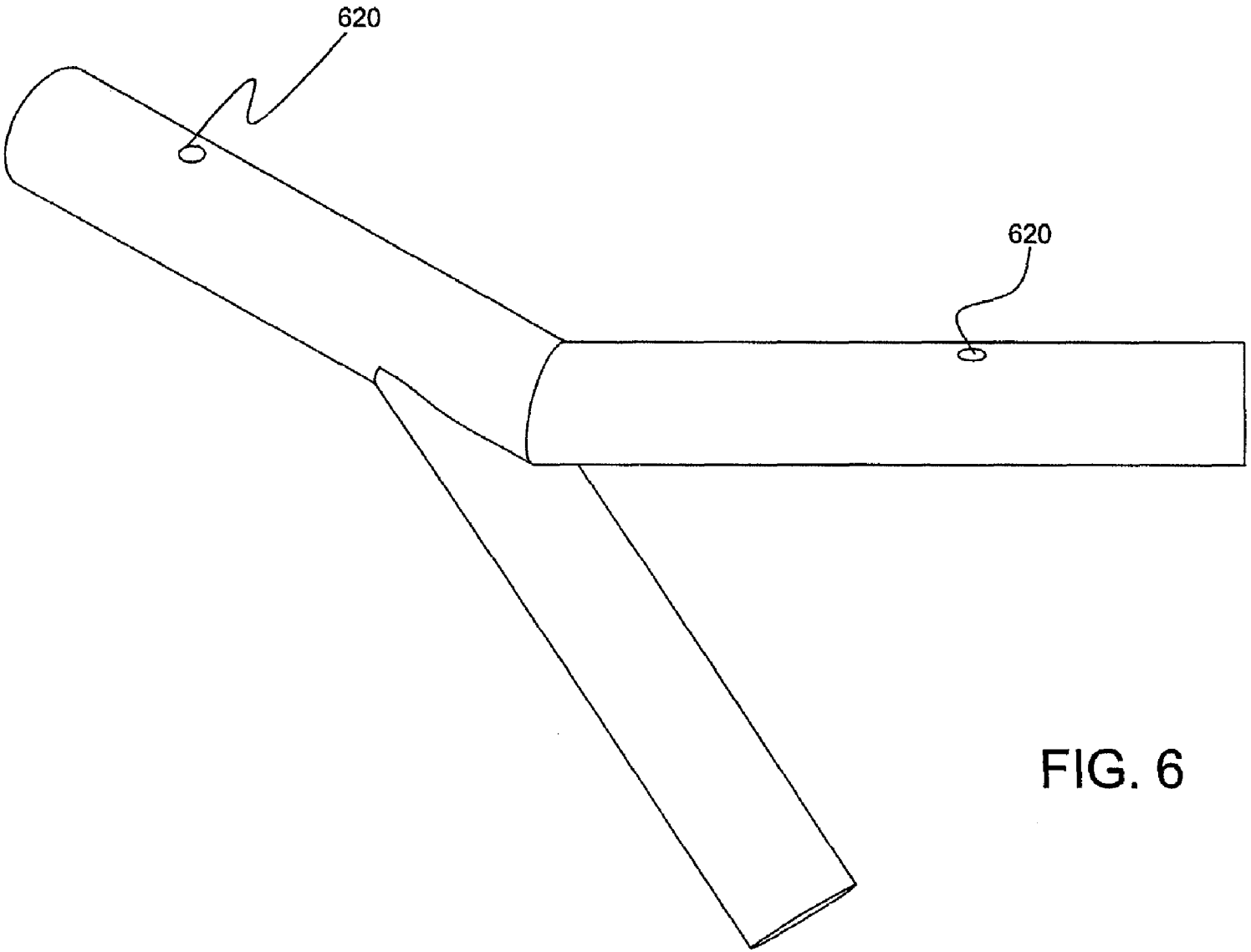
FIG. 6 shows a three-way joint for connecting three members.
Figure 7:
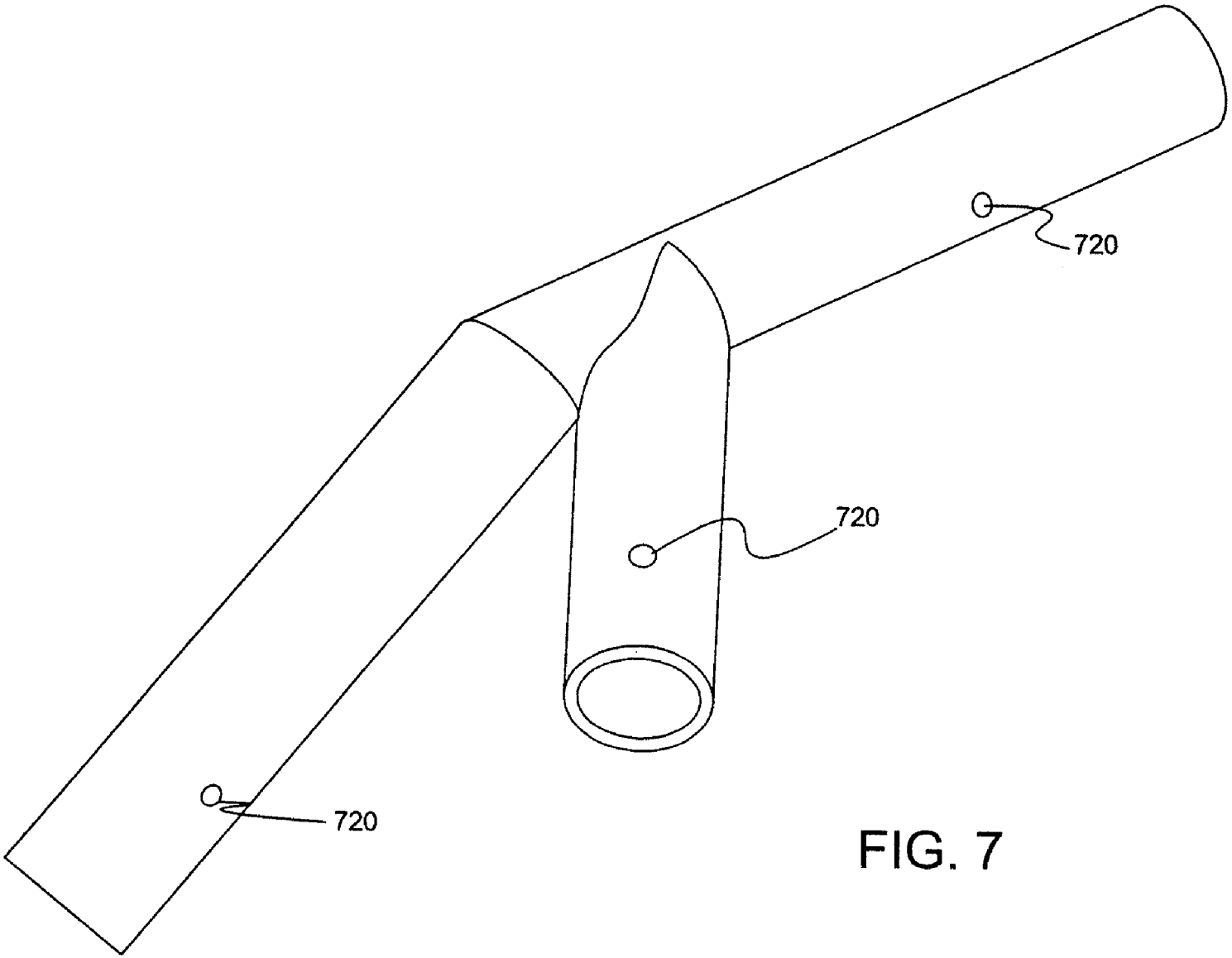
FIG. 7 represents a three-way joint which has different angles for connecting three members.

Similarly, FIG. 6 shows a three-way joint for connecting three members. Again, notches 620 can be optionally formed to secure an adjoining member with a complementary ball or release mechanism. FIG. 7 represents the three-way joint of FIG. 6 from a different angle. A similar numbering scheme is used in FIG. 7 to identify the various portion of the three-way joint.

Figure 8:
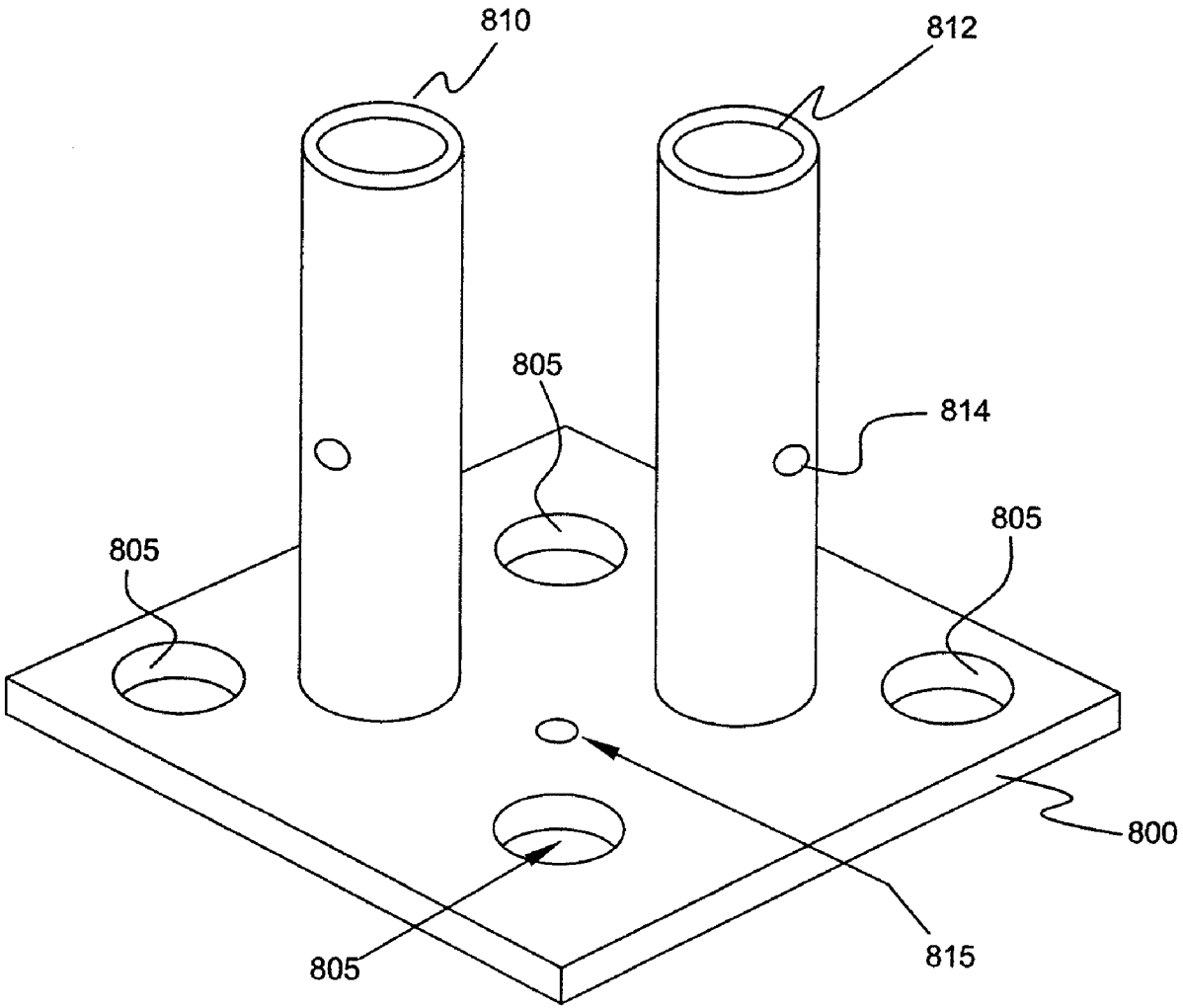
FIG. 8 shows an exemplary base plate adapted to receive two legs.

FIG. 8 shows an exemplary base plate adapted to receive two legs. Base plate 800 is shown to have four holes 805 formed therein. Holes 805 can be devised to receive an anchor bolt securing the base plate to the ground. Receiving tubes 810 can also be integrated to base plate 800. Each receiving tube 810 can releasably receive, for example, a leg of the modular frame 100 as shown in FIG. 1. Opening 812 can be sized to accommodate the appropriate members while rejecting others. Notch 814 is formed in the receiving tubes 810 to releasably engage a structural member or a leg having a complementary release or attachment mechanism. Cavity (or marker) 815 can be positioned centrally within the base plate to identify the tent frame size and provide a reference point for laying out the base plates prior to assembling the structural components.

Figure 9:
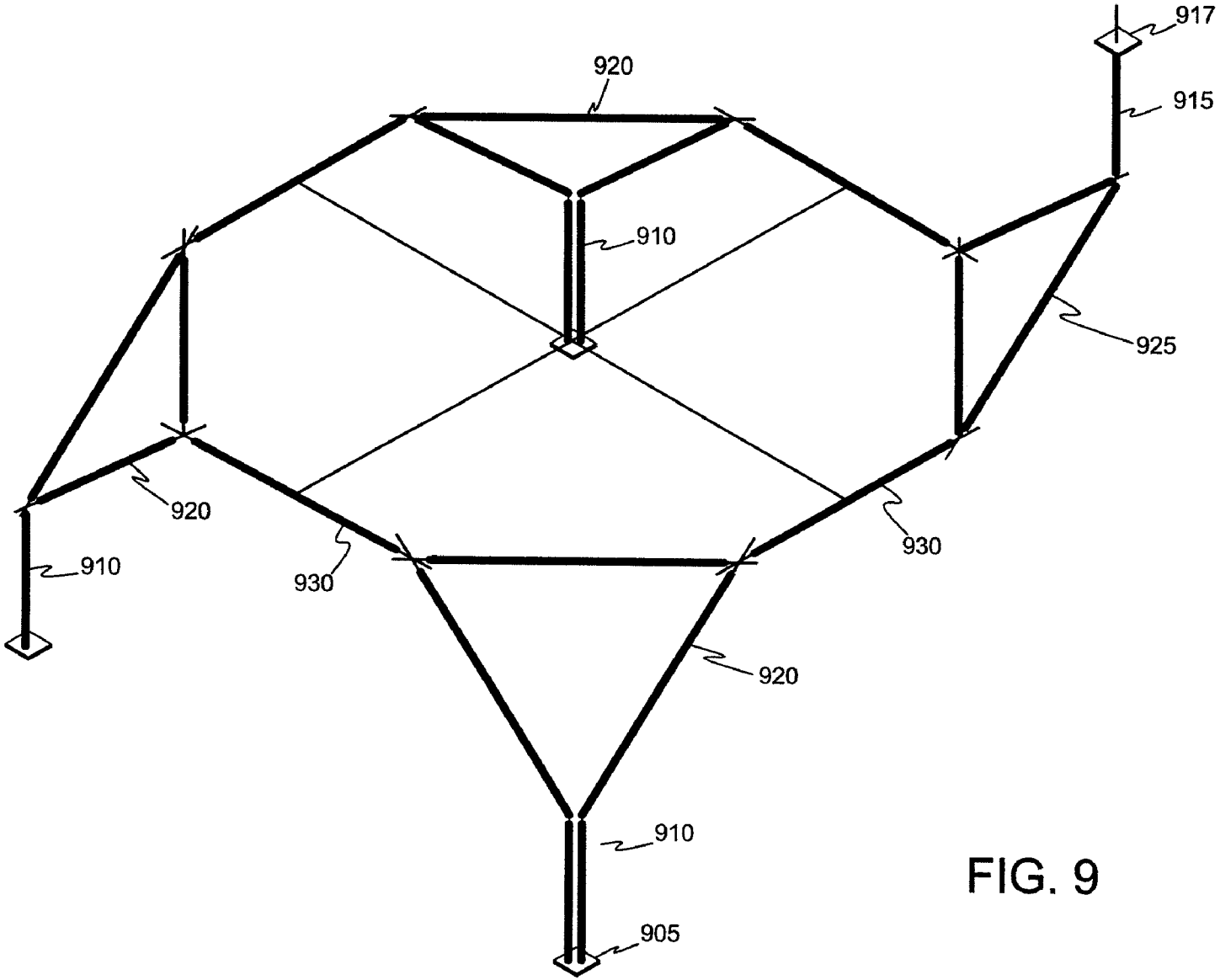
FIG. 9 shows an modular frame adapted to combine with similar frames to form a larger structure.

According to one embodiment of the disclosure several modular frames can be combined to form a larger structure. FIG. 9 shows a modular frame adapted to combine with similar frames to form a larger structure. Referring to FIG. 9, three of base plates 905 are positioned on the ground and adapted to receive two legs 910 each. In addition, each of base plates 905 supports a geodesic corner structure 920. Geodesic corner structure 925 is coupled to leg 915 which ends in base plate 917. Geodesic corner structure 925 as well as leg 915 and base plate 917 are rotated to point up-ward and away from the ground.

Figure 10:
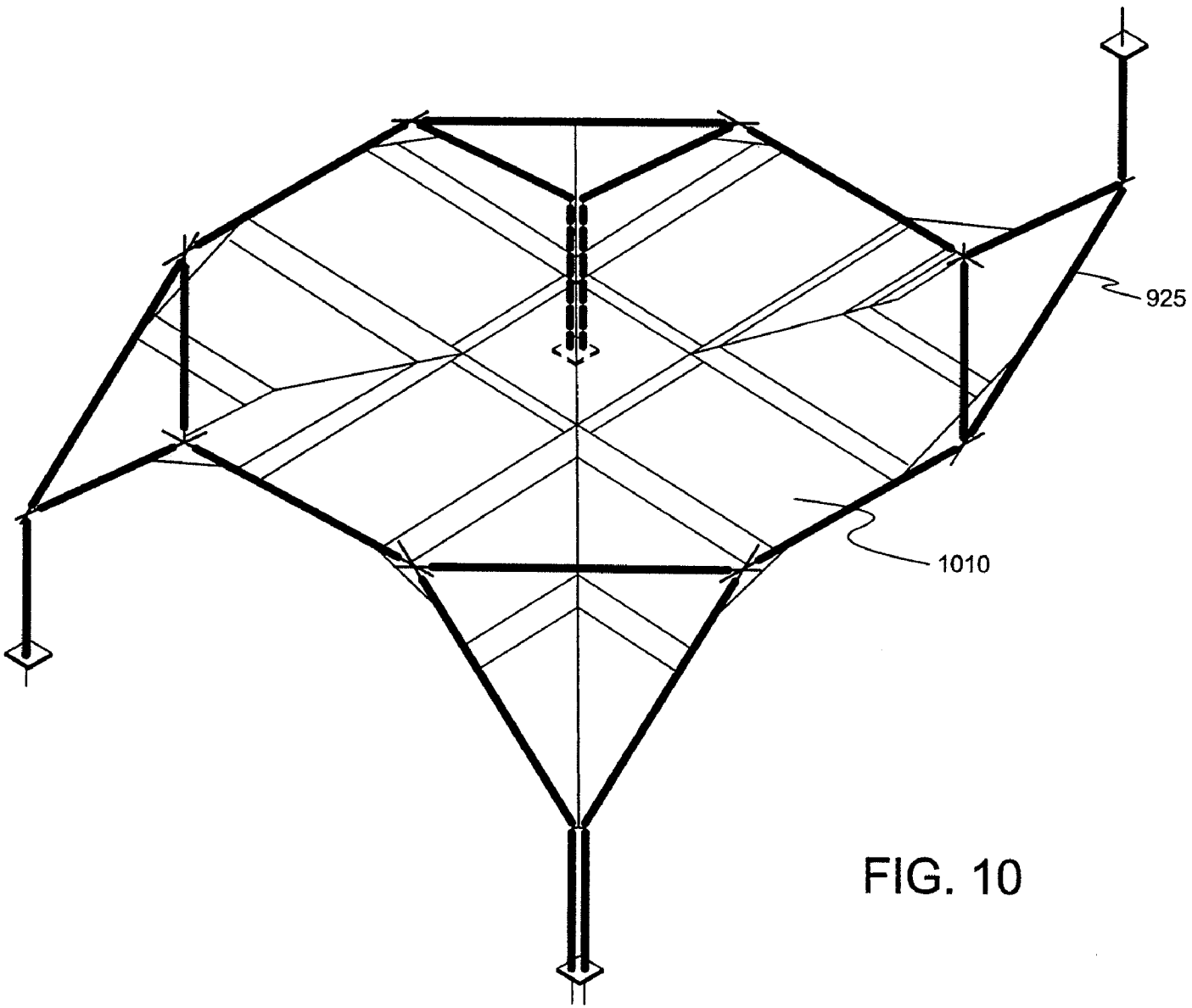
FIG. 10 shows the modular frame of FIG. 9 with a parabolic shaped roof cover assembled thereon.

FIG. 10 shows the modular frame of FIG. 9 with roof cover 1010 assembled thereon. It can be readily seen that cover 1010 extends to cover geodesic corner structure 925 which is turned upward.

When creating a larger interior clear span modular frame tent, four of the basic Modular Frames can be grouped together. Three of the geodesic corner and leg assemblies of each modular frame, are assembled normally; while the fourth is reversed, with the geodesic corners and leg assembly pointed upward. The four center geodesic corners and leg assemblies are attached to the Top Modular Assembly Base plate 1200, which allow the structural forces from the center to be balanced against each other when assembled. Due to structural requirements for snow or wind loadings, an interior wire cable system may be added between the octagonal frames. Opening the center of the Modular Assembled tents, in distances of 20 feet to 80 feet or larger, allows the larger clear spanned area to be available, while maintaining the larger clear side openings. This configuration of Modular Frames to create larger structures without special beam or truss span components, thereby reducing the quantity of perimeter legs while obtaining the larger clearance spaces and reducing the time needed to set up these larger tents.

Figure 11:
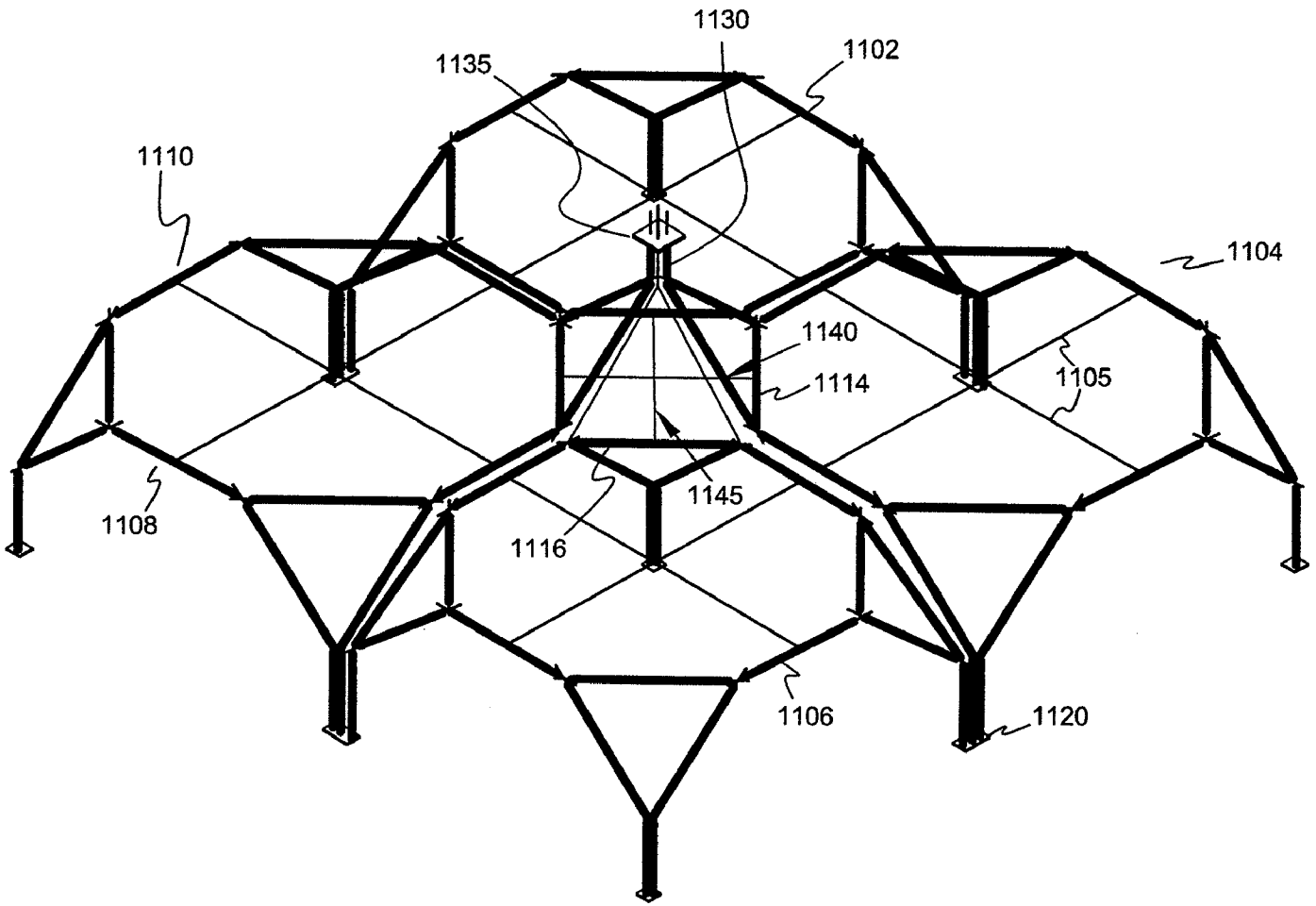
FIG. 11 shows the combination of several modular frames as shown in FIG. 9.

FIG. 11 shows the combination of several modular frames as shown in FIG. 9. Namely, FIG. 11 shows the combination of modular frames 110, 1104, 1106 and 1110. At the point where each two modular frames join (e.g., frames 110 and 1106) the legs can be supported by a specially-adapted base plate 1120 which can accommodate 2 or more legs or use the standard leg base plate connected adjacent to each other. Additional joiner elements (not shown) that couple other members (e.g., legs) of the coupled frames may optionally be used. As shown in FIG. 11 each frame 1102, 1104, 1106, and 1110 will have one geodesic corner structure and leg turned upward. The upwardly-facing geodesic corner structures and legs for each of the modular frames can be joined at the center to form center peak 1130. Peak 1130 provides a means for shedding water and other debris and provides structural stability. To provide additional structural stability, the legs from the joinder of the geodesic corners can be coupled through top plate 1135 or similar devices. Further structural rigidity can be provided by optionally assembling tensions wires 1140 and 1145 which connect support members 1112, 1114, 1116 and 1118.

Cross members 105 are also shown in FIG. 11. These cross members can be tension wires separated by a spacer (not shown) such that the top tension wire is slightly elevated over the bottom tension wire. Thus, each of the modular frames 1102, 1104, 1106 and 1110, when covered by a roof material will have a slight peak for shedding water.

Figure 12:
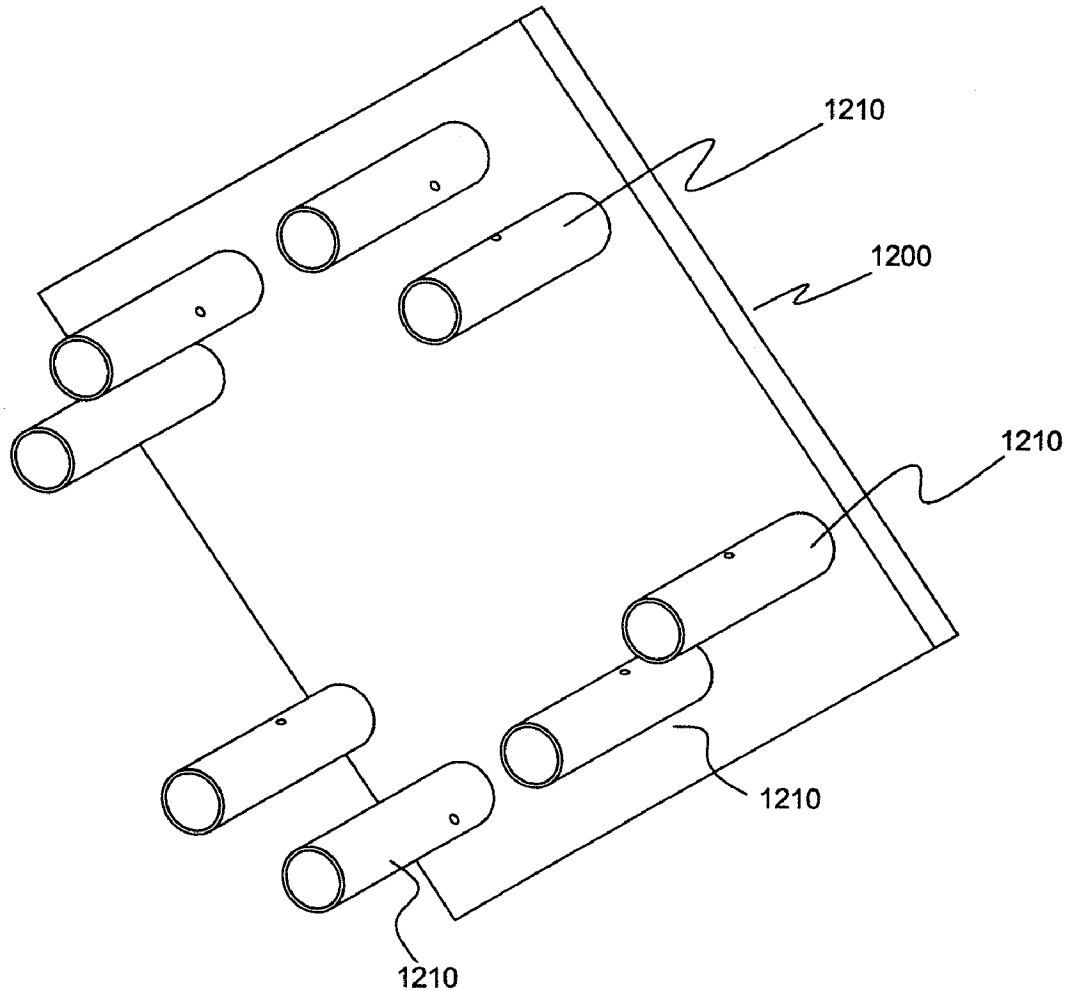
FIG. 12 shows the top modular assembly top plate 1200 as demonstrated in the assembly of FIG. 11.

FIG. 12 shows top plate 1200 as demonstrated in the assembly of FIG. 11. In FIG. 12, top plate 1200 includes several receiving tubes 1210. Each receiving tube 1210 is sized to releasably receive a leg member associated with a modular frame of the structure. Top plate 1200 also shelters the opening at top of peak 1130 (see FIG. 11).

Figure 13:
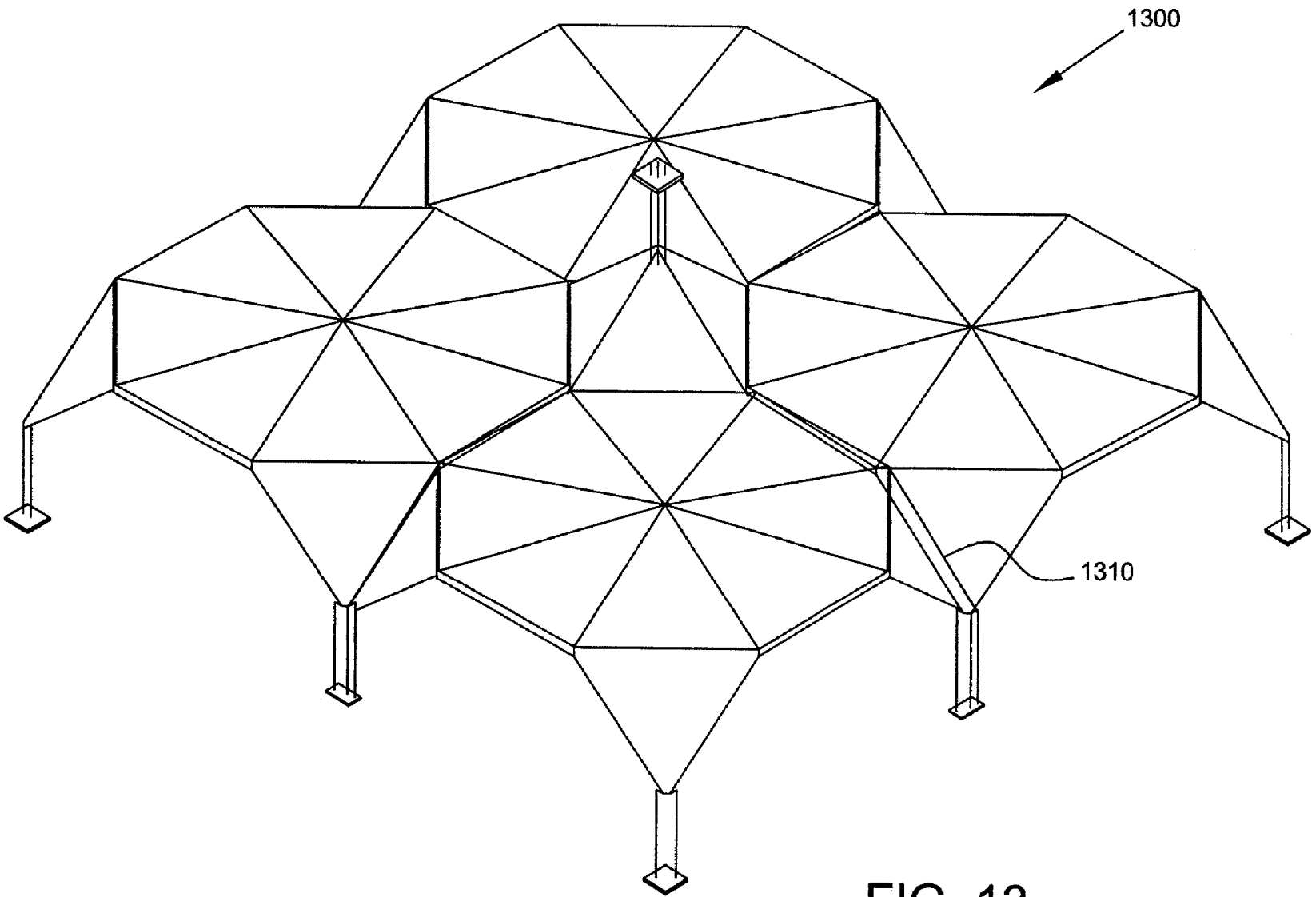
FIG. 13 is a schematic representation of the structure shown in FIG. 11 with a top cover assembled thereon.

FIG. 13 is a schematic representation of a modular structure 1300 including the structure shown in FIG. 11 with a top cover assembled thereon. The top cover in this schematic is attached to the top of the modular frame assembly pipe. The modular frame 1300 can be devise so as to minimize seams 1310. Alternatively, seam covers (not shown) can be provided to obviate water leakage.

Figure 14:
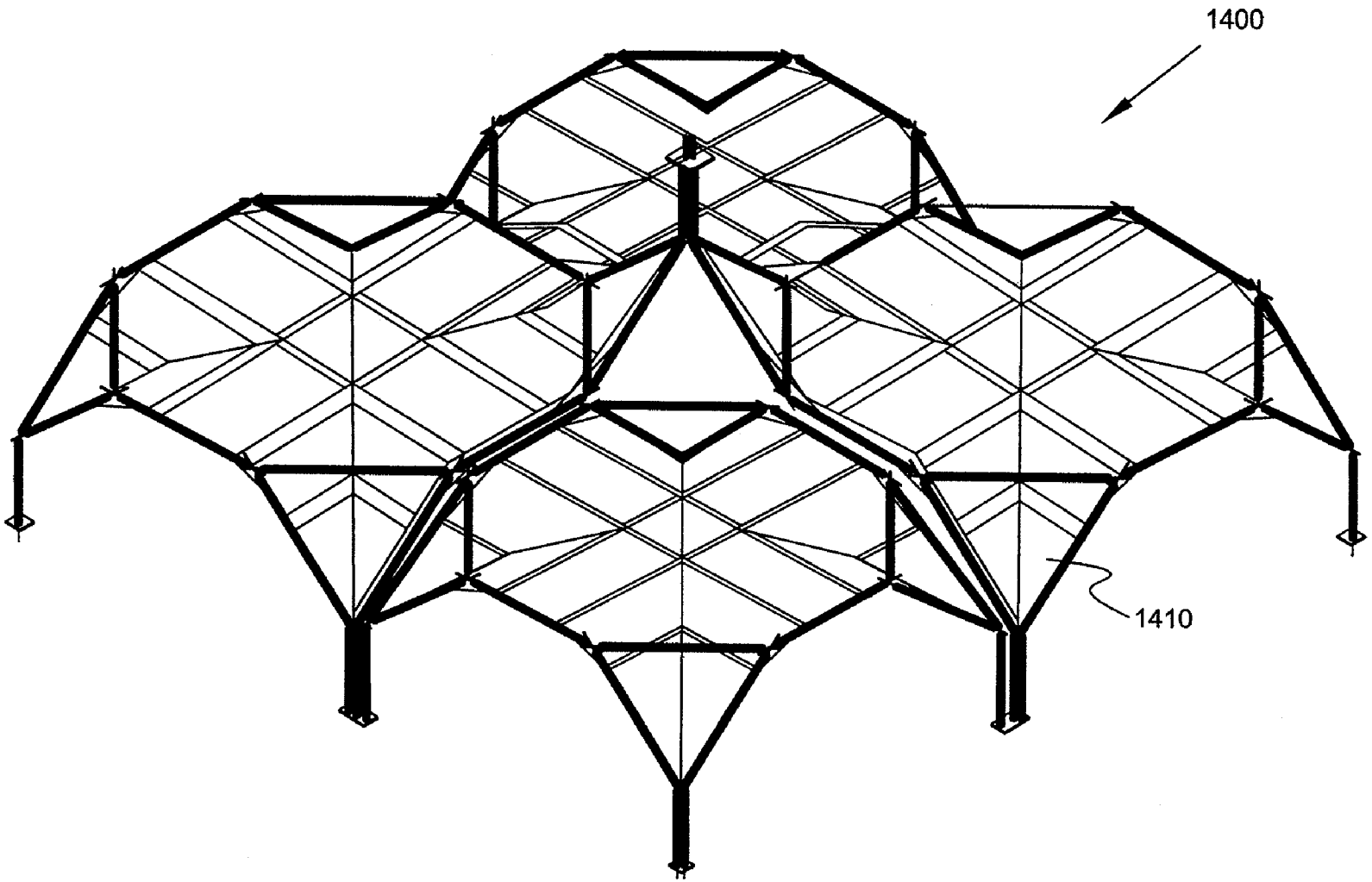
FIG. 14 is a schematic representation of the structure shown in FIG. 11 with a parabolic shaped top cover assembled thereon.
Figure 15:
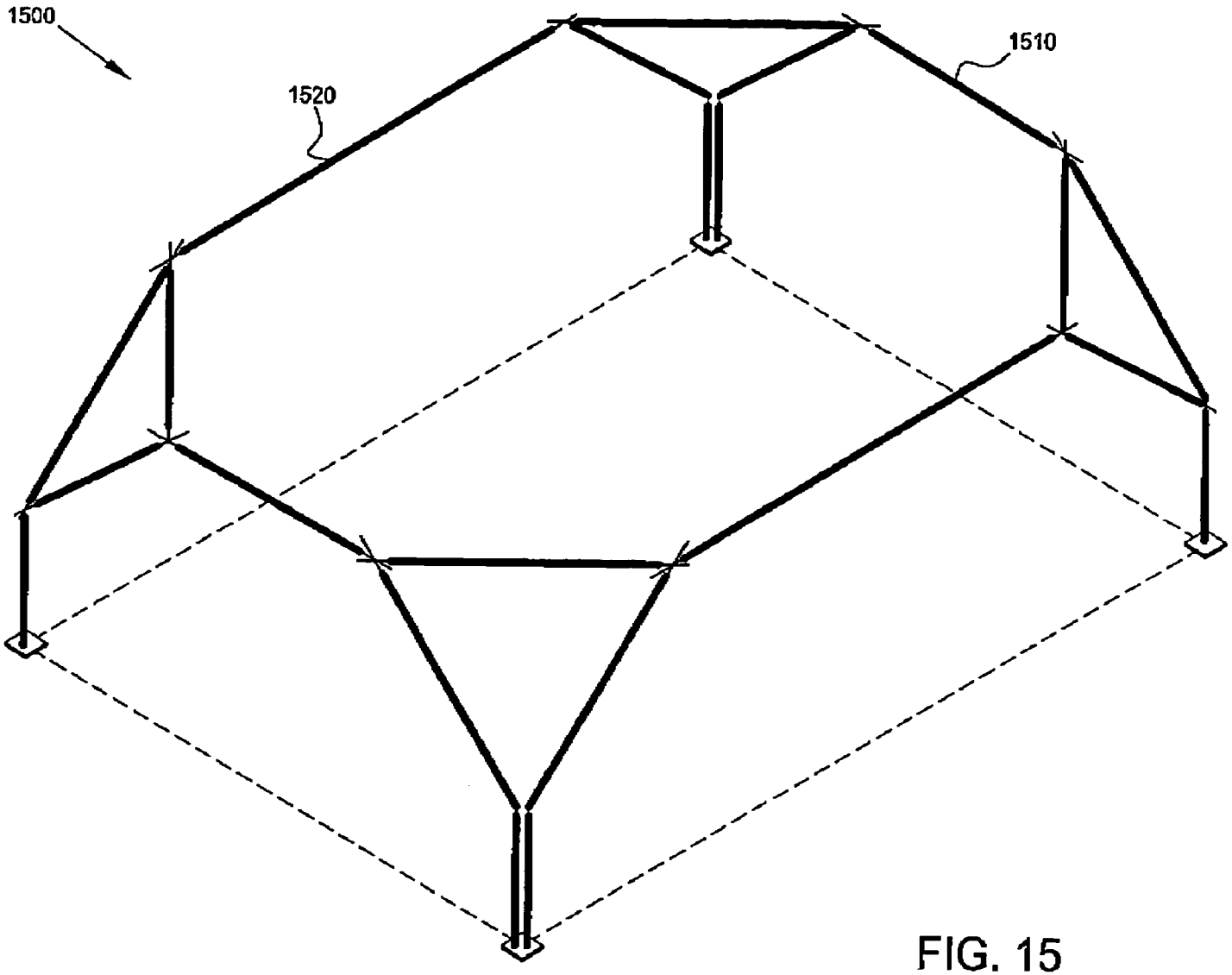
FIG. 15 is a schematic representation of a modular frame with support members 1510 and 1520 of varying length.

FIG. 14 is another schematic representation of a modular structure 1400 including the structure shown in FIG. 11 with a top cover assembled thereon. The top in the representation of FIG. 14 is a parabolic top which can be attached to the underside of the modular frame pipe. The openings between the modular frame parabolic tops is closed with a joint cover (not shown) to obviate water leakage.

It can be seen that the embodiments disclosed herein provide a structural frame that, among other: (1) reduces the visual obstruction of standard tent roofs; (2) reduces the length of pipe components required to construct a frame tent; (3) reduces assembly and disassembly time; and (4) increases the width size of slip joint frame constructed tents.

The embodiments disclosed herein are exemplary in nature and are not intended to limit the scope of the principles disclosed and/or claimed herein. Other embodiments which are not specifically described herein can be made in accordance with the principles of the disclosure and within the scope of these principles.

What is claimed is:

1. A modular structure comprising:

a plurality of support members forming an eight-sided roof support structure and a roof perimeter for the free-standing structure, each of the plurality of support members having a proximal end and a distal end;

a roof fabric covering the roof support structure;

a plurality of geodesic load transfer structures upholding certain of the support members and transferring the weight of the roof support structure;

a cross-member connecting a pair of opposing support members at a location between the proximal end and the distal end of the pair of opposing members;

a plurality of vertical legs communicating with the load transfer structure and receiving the weight of the roof support structure and upholding the free-standing structure, the plurality of vertical legs forming a footprint perimeter for the free-standing structure;

wherein the footprint perimeter is larger than the roof perimeter and wherein the modular structure defines a cubic structure.

2. The modular structure of claim 1, wherein the geodesic load transfer structure comprises a triangular structure.

3. The modular structure of claim 2, wherein at least one member of the triangular structure is one of the support members.

4. The modular structure of claim 1, wherein the geodesic load transfer structure comprises a plurality of parabolic members structurally communicating with the roof support structure.

5. The modular structure of claim 4, wherein each parabolic member extends from the roof support structure.

6. The modular structure of claim 1, wherein the weight of the roof support structure and the roof fabric is born by said legs.

7. The modular structure of claim 1, wherein the roof fabric is exclusively supported by the support members and the load transfer structures.

8. A free standing structure comprising:

a plurality of support members forming an eight-sided roof for receiving a roof cover, each of the plurality of support members having a proximal end and a distal end;

a cross-member connecting a pair of opposing support members at a location between the proximal end and the distal end of the pair of opposing members;

a plurality of geodesic structures, each geodesic structure sharing at least one support member with the eight-sided roof to define a geodesic area; and a plurality of legs, each leg structurally corresponding with one of the plurality of geodesic structures, the plurality of legs defining a footprint area for the free standing structure;

wherein the footprint area is substantially equal to a sum of a roof cover area and the geodesic areas and wherein the eight-sided roof and the plurality of legs define a cubic structure.

9. The free standing structure of claim 8, further comprising a fabric roof cover.

10. The free standing structure of claim 8, further comprising a roof cover which extends beyond the eight-sided roof to cover at least one of the plurality of geodesic areas.

11. The free standing structure of claim 8, wherein each leg is an extension of a corresponding geodesic structure.

12. The free standing structure of claim 8, wherein each leg further comprises two parallel leg members.

13. The free standing structure of claim 8, wherein each leg is defined by one leg member.

14. A method for assembling a free-standing coverage for an obstruction-free area, the method comprising:

providing an eight-sided support structure receiving a roof cover;

providing and connecting a cross-member to a pair of opposing members of the support structure;

providing a plurality of geodesic corner structures to extend from the support structure and receiving a geodesic cover; and freestanding the roof cover by connecting each of the geodesic corner structures to an upright leg member respectively to thereby form a cubic-structure defined by the eight-sided support structure;

wherein the cross-member connects the pair of opposing members at a location between ends of each of the pair opposing members and at a location other than the geodesic corner structures.

15. The method of claim 14, wherein the area covered by the roof-cover and the geodesic covers substantially covers an area defined by the plurality of leg members.

16. The method of claim 14, wherein the upright leg member defines two vertical legs.

17. The method of claim 14, wherein at least one upright leg member defines a vertical leg.

18. The method of claim 14, further comprising connecting a free end of each upright leg member to a base-plate.

19. The method of claim 14, wherein the eight-sided support structure is an octagonal structure.

20. A free standing structure comprising:

an eight-sided rigid planar frame forming a roof structure, the planar frame having a roof perimeter;

a cross-member connecting a pair of opposite members of the eight-sided rigid planar frame at a location between ends of each of the pair opposite members;

a plurality of rigid geodesic load-bearing members coupled to the eight-sided frame and transferring a load from the eight-sided rigid planar frame to proximal ends of a plurality of corresponding vertical legs;

a plurality of base-plates, each base-plate receiving the load from a distal end of a corresponding leg, the plurality of base-plates defining a foot-print perimeter for the free-standing structure;

wherein the footprint perimeter is larger than the roof perimeter and wherein the structure free standing defines a cubic structure.

* * * * *